United States Patent [19]

McCoy et al.

[11] Patent Number: 4,869,912

[45] Date of Patent: Sep. 26, 1989

[54] PRE-FILLED NURSER POUCH

[75] Inventors: Ned R. McCoy; James C. Lierman, both of Dublin, Ohio

[73] Assignee: Abbott Laboratories, Abbott Park, Ill.

[21] Appl. No.: 155,468

[22] Filed: Feb. 12, 1988

[51] Int. Cl.[4] ..... B65D 30/10; B65D 35/00; B65D 27/32; A61J 9/00

[52] U.S. Cl. ..... 426/123; 215/11.3; 220/404; 206/604; 426/106; 426/115; 426/117

[58] Field of Search ..... 426/117, 122, 123, 115, 426/106; 220/403, 404; 215/11.1, 11.3, 11.6, 11.2, 11.4, 11.5; 383/907

[56] References Cited

U.S. PATENT DOCUMENTS

| | | | |
|---|---|---|---|
| 2,628,906 | 2/1953 | Horan | 426/117 |
| 2,803,365 | 8/1957 | Allen | 215/11.3 |
| 2,826,324 | 3/1958 | Hoag | 215/11.3 |
| 2,881,935 | 4/1959 | Garred | 215/11.3 |
| 2,885,104 | 5/1959 | Greenspan | 426/117 |
| 3,204,855 | 9/1965 | Boynton et al. | 215/11.3 |
| 3,255,923 | 6/1966 | Soto | 215/11.3 |
| 3,362,555 | 1/1968 | Soto | 215/11.3 |
| 3,386,604 | 6/1968 | Fields | 215/11.3 |
| 3,500,831 | 8/1970 | Schar | 215/11.5 |
| 3,523,026 | 8/1970 | Emerson et al. | 215/11.3 |
| 3,762,542 | 10/1973 | Grimes | 215/11.3 |
| 3,799,914 | 3/1974 | Schmit et al. | 426/115 |
| 3,871,542 | 3/1975 | Hammer | 215/11.3 |
| 4,339,046 | 7/1982 | Coen | 215/11.4 |
| 4,637,934 | 1/1987 | White | 426/117 |
| 4,678,092 | 7/1987 | Rane | 426/117 |

FOREIGN PATENT DOCUMENTS

| | | | |
|---|---|---|---|
| 3309390 | 9/1984 | Fed. Rep. of Germany | 215/11.1 |
| 2232300 | 1/1975 | France | 215/11.3 |
| WO8504574 | 10/1985 | PCT Int'l Appl. | 426/117 |
| WO8800038 | 1/1988 | PCT Int'l Appl. | 426/117 |

*Primary Examiner*—Steven Weinstein
*Attorney, Agent, or Firm*—Donald O. Nickey

[57] ABSTRACT

An aseptically pre-filled, clear plastic pouch for a nurser is insertable into a sleeve-like holder and has upwardly diverging side edges at its upper end for gripping same and to provide sufficient material to be folded downwardly over the upper edge of the holder after opening of the pouch and before assembly of a nursing nipple on the upper end of the holder, one or more V-shaped notches being provided just below a sealed upper edge of the pouch as an aid in opening same. The aseptically pre-filled pouch provides a convenient single serving of a pediatric nutritional which has an excellent shelf-life without refrigeration, the plastic film material being a multi-layer co-extrusion which is not only puncture-resistant but which also has excellent oxygen and water barrier properties.

1 Claim, 3 Drawing Sheets

PRE-FILLED NURSER POUCH

BACKGROUND OF THE INVENTION

There are currently present on the market several infant nurser kits which include a supply of empty, clear plastic bags, some of which may be interconnected by perforations and formed in a roll. The bag must be carefully inserted into a suitable sleeve like shell or holder, the upper edge of the bag being folded over the upper edge of the holder. The bag must then be filled with previously purchased infant formula or other pediatric liquids, after which a nursing nipple/retainer assembly is threadably mounted thereon. Surveys indicate that 40–50% of new mothers in the United States of America use such "disposable bottles" in feeding their infants and older babies and that an average of five such "disposables" are used per day. One possible problem with this current practice is that storage must be provided for both the bags and the premixed formula, the latter of which is often in the form of unwieldy cases of cans or glass bottles, and that, therefore, one might understandably run out of one or the other, which could result in the infant or older baby not being fed on schedule. Further, several separate, rather intricate steps are required, each of which has to be undertaken with extreme care to ensure against contamination of whatever pediatric nutritional is to be given to the infant or older baby.

SUMMARY OF THE INVENTION

The present invention is directed to a flexible, clear plastic disposable pouch which has been aseptically filled with infant formula or other pediatric nutritional and immediately sealed in a commercially sterile environment to prevent contamination thereof. In that these single-serving pre filled pouches are aseptically filled with suitable formulations of pediatric nutritionals, they have an excellent non-refrigerated shelf stability. Further, such pouches may also be aseptically pre filled with sterilized water, glucose water, juices, etc.

The pouches themselves are formed out of a suitable multi-layered clear plastic material which provides both good oxygen and water barrier characteristics as well as high resistance to puncturing.

The unique shape of the subject pre-filled pouch is such that it allows easy entry thereof into any one of several suitable sleeve-like holders adapted to have a nursing nipple assembled thereon. The upper edge of each pre-filled pouch is notched to facilitate opening thereof after insertion of the pouch into a suitable nursing holder.

Still further, the subject pre-filled, single serving nurser pouch is lightweight and convenient to shop for and store, being flexible, unbulky, very portable and requiring no refrigeration. The subject pre-filled pouches, which may be printed with volumetric graduations, also permit the purchaser/user to view the contents thereof through the clear plastic material and also permits convenient heating of the contents prior to opening of the pouch by simply dropping the sealed pouch into a pan of heated water or holding it under a faucet of warm running water.

DESCRIPTION OF THE PREFERRED EMBODIMENT

Figure 1:
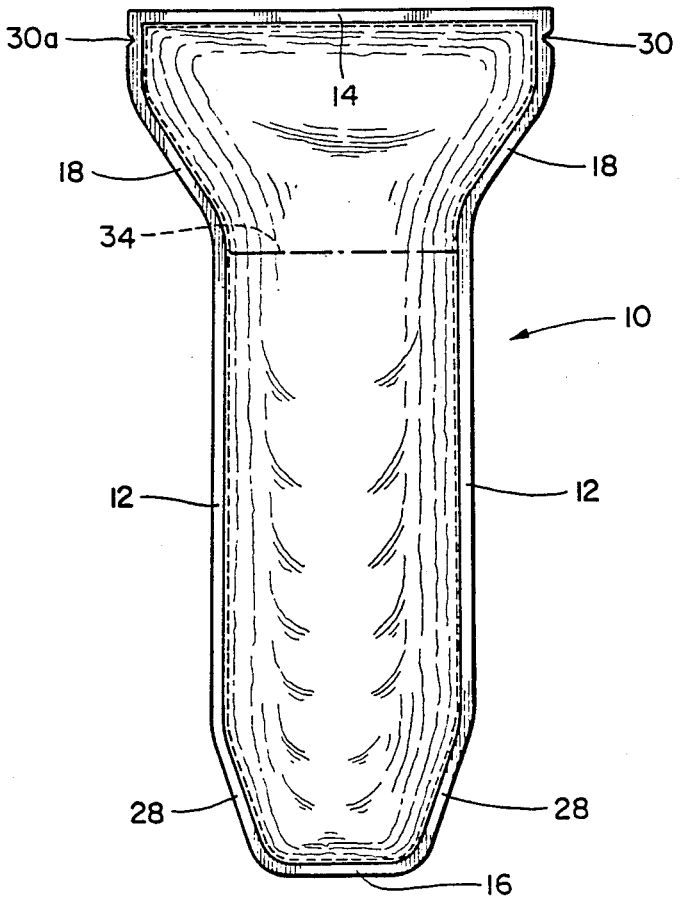
FIG. 1 is a front elevational view of an aseptically pre filled pouch for a nurser embodying the present invention.
Figure 2:
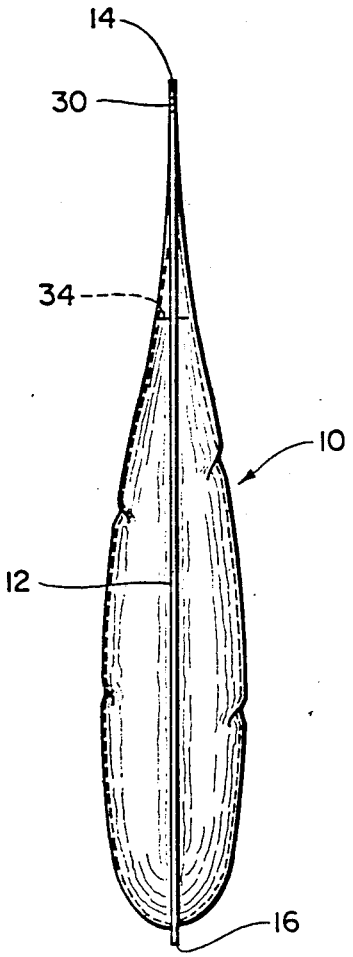
FIG. 2 is a side elevational view thereof as viewed from either side.
Figure 3:
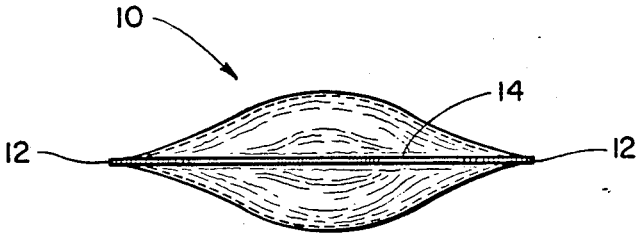
FIG. 3 is a top plan view thereof.

Referring now to the drawings, a preferred form of an aseptically pre-filled pouch 10 for an infant or baby nurser is shown in FIGS. 1–3. The pouch 10 is formed from a roll of multi-layered plastic film material which is strong and puncture resistant and has excellent oxygen and water barrier characteristics, as will be described more fully hereinafter. The film material is sterilized, formed, and filled with either sterilized water, glucose water, juices or pre mixed formulas or other suitable pediatric nutritionals such as Ross Laboratories' Similac, Isomil, Pedialyte, etc., and then sealed in a commercially sterile environment to provide a convenient, portable, lightweight, single serving package which has excellent shelf life stability without refrigeration. The pre-filled pouch 10, being clear whereby the contents are visible to the purchaser/user, is flexible, easily stored, and permits easy warming of the contents by either placing the unopened pouch 10 in a pan of heated water or by holding the pouch 10 under a faucet of warm running water. Although not shown in the drawings, the clear plastic pouches 10 may be printed with volumetric graduations. The pouch 10 may be aseptically formed, filled and sealed in one operation in a manner such that non-contamination of the contents is ensured.

Figure 4:
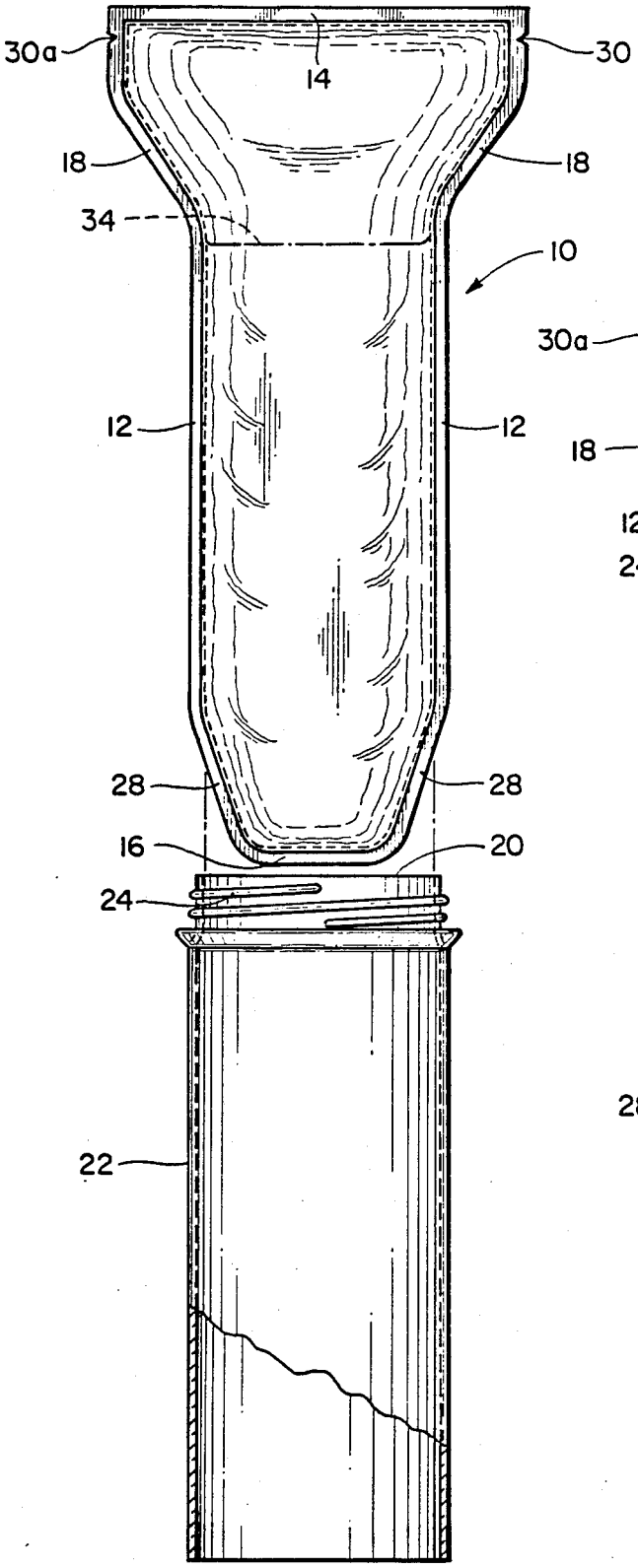
FIG. 4 is a front elevational view of the pre-filled pouch of FIGS. 1–3 as same is about to be inserted into a sleeve like holder which is shown partially in vertical section.
Figure 5:
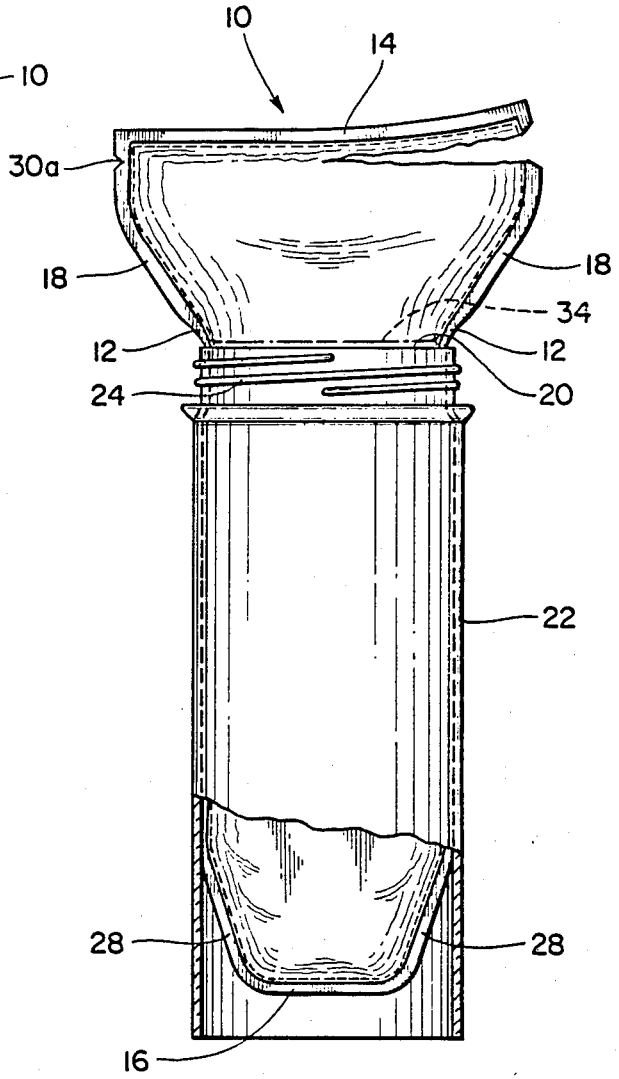
FIG. 5 is a front elevational view after insertion of the pouch into the holder and as the pouch is being opened.
Figure 6:
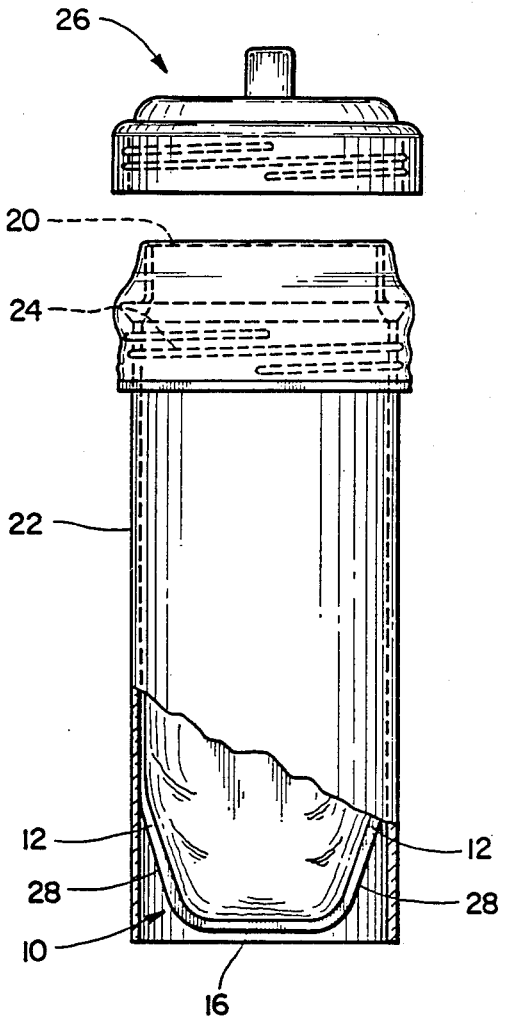
FIG. 6 is a front elevational view after the pouch has been opened and the top portion thereof folded over the upper edge of the holder but prior to assembly of the nursing nipple thereon.
Figure 7:
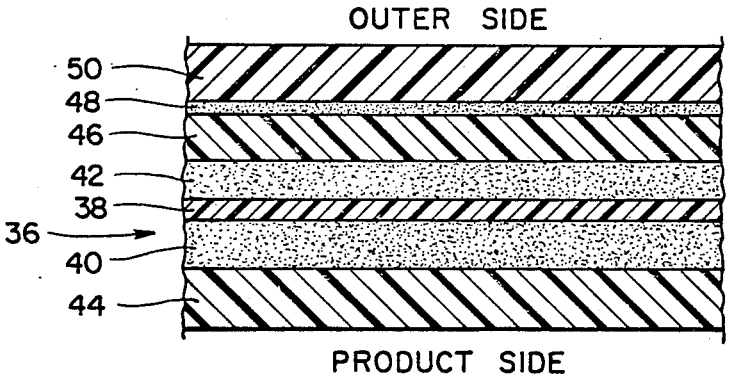
FIG. 7 is an enlarged fragmentary transverse sectional view taken through the plastic film from which the pre-filled pouch of the present invention is formed and illustrating the multi-layer structure thereof.

The pre filled pouch 10 is characterized by heat sealed side edges 12, by a heat sealed or folded top edge 14, and by a heat-sealed or folded bottom edge 16. The upper portion of the side edges 12 of the pre filled pouch 10 diverge in an upward direction, as at 18 in FIG. 1, to facilitate handling the pouch 10 and to provide sufficient pouch material to be folded downwardly over an upper edge 20 of a suitable sleeve like cylindrical holder 22 after opening of the pouch 10, as illustrated in FIG. 6. As best illustrated in FIGS. 4, 5 and 6, the disposable pre filled pouch 10 is adapted to be inserted into either the top or the bottom of the sleeve-like holder 22 which is of a known type having external threads 24 provided on its upper end for threadably receiving thereon a nursing nipple and threaded retainer assembly 26, as illustrated in FIG. 6. Although not shown in the drawings, some holders may have a reverse taper wherein the circumference at the lower end is slightly greater than at the upper end.

As best illustrated in FIG. 4, the lower portion of the side edges 12 of the pouch 10 may converge in a downward direction, as at 28, to facilitate downward entry of the pre filled pouch 10 into the holder 22. Engagement of the side edges 12 with the inner surface of the holder 22 tends to round out the main body portion of the pre-filled pouch 10 from its normal generally elliptical shape, which is best illustrated in FIG. 3, whereby the pouch 10 fits snugly within the cylindrical holder 22.

A V-shaped notch 30 is provided in one of the side edges 12 of the pre-filled pouch 10 just below the sealed top edge 14 thereof to facilitate tearing off the top edge 14 to open the pouch 10 after the pre-filled pouch 10 has been inserted into the holder 22, as best illustrated in FIG. 5. Preferably, a second V-shaped back up notch **30*a* is provided in the opposite side edge 12, as insurance should the notch 30 not function correctly to open the upper end of the pre-filled pouch 10. A relatively linear tear from the notch 30 (or back up notch 30*a*) is made possible by using unidirectionally oriented plastic film material. As the maximum fill level for the pre-filled pouch 10 is indicated by the broken line 34, it is evident that, after the top edge 14 has been removed, there is sufficient pouch material to be folded over the upper edge 20 of the holder 22 and to overlap the holder threads 24 without spilling the contents of the pre-filled pouch 10. As the basic structure and shape of the pre-filled pouch 10 are of importance as noted herein, so is the specific multi-layered structure of the clear plastic film material from which the pre-filled pouch 10 is formed. Although it is obvious that this film material must be strong and puncture resistant, it must also provide excellent oxygen and water barrier characteristics. As illustrated in FIG. 8, one such film structure is characterized by a five layer co extrusion 36 including an inner layer of clear plastic 38 having excellent oxygen barrier characteristics, layers of suitable adhesive 40 and 42 on opposite surfaces thereof to each of which is laminated a layer of clear plastic 44 and 46, respectively, having excellent water barrier characteristics. The layer 44 serves as the inner surface of the pre filled pouch 10 which is exposed to the product contained within the pouch 10. Laminated to the other layer 46 by means of a thin layer of adhesive 48 is a layer 50 of clear plastic which has excellent puncture resistant properties and which therefore serves as the outer side surface of the pre-filled pouch 10**. Other multi-layer clear plastic film materials may prove to be equally or even more effective.

The fact that the subject pre-filled pouch 10 has excellent shelf life stability without refrigeration is a result of the aseptic filling of the product, packaging barrier properties and, in some instances, product reformulation.

The convenience, reliability and safety features of this infant/baby feeding advance are believed quite obvious. Compared to the current practice of the mother finding an empty disposable nurser bag, then hopefully finding a can of the product to be fed to the infant, opening the bag and inserting the limp bag into a holder and then opening the can of the product and carefully emptying it into the bag while doing her best to ensure against contamination of the product, the advance disclosed herein is much simpler and requires many fewer steps with insurance against contamination being assured. The mother simply picks up the single-serving pre-filled pouch 10 disclosed herein, inserts it into the holder (after warming it as described herein, if desired), pulls off the top of the pouch 10, folds over the excess pouch material, and then assembles the nipple/-retainer ring 26.

While there has been shown and described a preferred embodiment of the invention, it will be obvious to those skilled in the art that changes and modifications may be made without departing from the invention, and it is intended by the appended claims to cover all such changes and modifications as fall within the true spirit and scope of the invention.

We claim:

1. An aseptically pre-filled sealed pouch that is to be secured to a sleeve-like holder and nursing nipple assembly comprising an aseptic pouch and an aseptically filled infant formula sealed therein, said pouch being formed of clear multi-layered plastic film material having high oxygen and water barrier properties such that, combined with the aseptic filling, said material imparts to the pouch excellent shelf life stability without refrigeration; said pouch having aseptically sealed side edges and an aseptically sealed top and bottom edge; each said sealed side edge including a major middle portion and minor lower and upper portions; said lower portions of said sealed side edges converging toward each other downwardly and inwardly from the middle portion sufficient to facilitate downward entry of said sealed pouch into said holder; said upper portions of said sealed side edges diverging upwardly and outwardly from each other and said middle portion sufficient to provide sufficient plastic film material to be folded downwardly over the upper edge of said holder when said top seal of said pouch is opened and said pouch is disposed in said holder; and wherein a V-shaped notch is provided in at least one of said sealed side edges in the upper part of said upper portion and just below said sealed top edge to facilitate tearing off said top edge and opening of said pouch.

* * * * *